US008723451B2

(12) United States Patent
Heid

(10) Patent No.: US 8,723,451 B2
(45) **Date of Patent: *May 13, 2014**

(54) ACCELERATOR FOR CHARGED PARTICLES

(75) Inventor: Oliver Heid, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/581,263

(22) PCT Filed: Feb. 2, 2011

(86) PCT No.: PCT/EP2011/051462

§ 371 (c)(1),
(2), (4) Date: Aug. 24, 2012

(87) PCT Pub. No.: WO2011/104077

PCT Pub. Date: Sep. 1, 2011

(65) Prior Publication Data

US 2012/0313554 A1 Dec. 13, 2012

(30) Foreign Application Priority Data

Feb. 24, 2010 (DE) ..... 10 2010 008 991

(51) Int. Cl.
*H05H 15/00* (2006.01)

(52) U.S. Cl.
USPC ..... 315/503; 315/500; 315/501; 315/502; 315/505; 315/506; 315/3.6; 315/5; 363/60

(58) Field of Classification Search
USPC ..... 315/500–506; 363/61
See application file for complete search history.

(56) References Cited

U.S. PATENT DOCUMENTS 2,887,599 A 5/1959 Trump ..... 313/74
4,092,712 A 5/1978 Harrigill, Jr. et al. ..... 363/60

(Continued)

FOREIGN PATENT DOCUMENTS

DE 976500 C 10/1963 ..... H05H 21/36
DE 2128254 1/1974 ..... H01J 33/00

(Continued)

OTHER PUBLICATIONS

International PCT Search Report and Written Opinion, PCT/EP2011/051468, 14 pages, Feb. 2, 2011.

(Continued)

*Primary Examiner* — Douglas W Owens
*Assistant Examiner* — Srinivas Sathiraju
(74) *Attorney, Agent, or Firm* — King & Spalding L.L.P.

(57) ABSTRACT

An accelerator for charged particle may include: a capacitor stack which includes a first electrode that can be brought to a first potential, a second electrode that is concentric to the first electrode and can be brought to a second potential differing from the first potential, and at least one intermediate electrode that is concentrically arranged between the first electrode and the second electrode and can be brought to an intermediate potential lying between the first potential and the second potential; a switching device to which the electrodes of the capacitor stack are connected and which is designed such that the concentric electrodes of the capacitor stack can be brought to increasing potential stages during operation of the switching device; a first and a second acceleration channel formed by first and second openings in the electrodes of the capacitor stack such that charged particles can be accelerated along the first and second acceleration channel by means of the electrodes; and a device which can influence the accelerated particle beam within the capacitor stack such that photons emitted by the particle beam are produced.

20 Claims, 8 Drawing Sheets

(56) References Cited

U.S. PATENT DOCUMENTS

| | | | | |
|---|---|---|---|---|
| 4,393,441 | A * | 7/1983 | Enge | 363/61 |
| 4,972,420 | A | 11/1990 | Villa | 372/2 |
| 5,135,704 | A | 8/1992 | Shefer et al. | 376/108 |
| 5,495,515 | A | 2/1996 | Imasaki | 378/119 |
| 5,757,146 | A | 5/1998 | Carder | 315/505 |
| 5,811,944 | A | 9/1998 | Sampayan et al. | 315/505 |
| 5,821,705 | A * | 10/1998 | Caporaso et al. | 315/507 |
| 6,459,766 | B1 * | 10/2002 | Srinivasan-Rao | 378/119 |
| 6,653,642 | B2 * | 11/2003 | Pedersen et al. | 250/492.21 |
| 7,218,500 | B2 * | 5/2007 | Adachi | 361/226 |
| 7,601,042 | B2 | 10/2009 | Srinivasan-rao et al. | 445/23 |
| 7,924,121 | B2 * | 4/2011 | Caporaso et al. | 333/236 |
| 7,952,288 | B2 | 5/2011 | Nakazato | 315/3.5 |
| 7,994,739 | B2 | 8/2011 | Chen | 315/504 |
| 2007/0145916 | A1 | 6/2007 | Caporaso et al. | 315/505 |
| 2007/0181833 | A1 | 8/2007 | Srinivasan-rao et al. | 250/493.1 |
| 2008/0290297 | A1 | 11/2008 | Blasche et al. | 250/492.3 |
| 2012/0068632 | A1 | 3/2012 | Heid | 315/500 |
| 2012/0313554 | A1 | 12/2012 | Heid | 315/503 |
| 2012/0313556 | A1 | 12/2012 | Heid | 315/506 |

FOREIGN PATENT DOCUMENTS

| | | | | |
|---|---|---|---|---|
| DE | 69008835 | T2 | 8/1994 | H01S 3/09 |
| EP | 0412896 | A | 8/1990 | H05J 5/00 |
| EP | 0471601 | A2 | 2/2002 | H05H 5/00 |
| GB | 1330028 | | 9/1973 | H01J 33/00 |
| GB | 2003318 | A | 3/1979 | H05H 5/06 |
| JP | 04341800 | A | 11/1992 | H05H 5/06 |
| JP | 07110400 | A | 4/1995 | G21K 5/02 |
| JP | 0896997 | A | 4/1996 | G21K 1/093 |
| JP | 2007518248 | A | 7/2007 | H01J 23/00 |
| JP | 2008503037 | A | 1/2008 | A61N 5/10 |
| WO | 2007/120211 | A2 | 10/2007 | |
| WO | 2008/051358 | A1 | 5/2008 | H05H 7/02 |
| WO | 2010/136235 | A1 | 12/2010 | H05H 5/06 |

OTHER PUBLICATIONS

Greinacher, H.: "Erzenanng einer Gleichspannung vom vielfachen Betrage einer Wechselspannung ohne Transformator"; Schweiz. Elektrotechnischer Verein, Bulletin No. 3, Mar. 11, 1920. Jahrgang, p. 59-66.

Weiner, M.,: "Analysis of Cockcroft-Walton Voltage Multipliers with an Arbitrary Number of Stages"; The Review of Scientific Instruments, vol. 40, No. 2, Feb. 1969, p. 330-333.

Everhart at al.. "The Cockcroft-Walton Voltage Multiplying Circuit"; The Review of Scientific Instruments, vol. 24, No. 3 Mar. 1953, p. 221-226.

Greinacher, H.,; "Über eine Methode, Wechselstrom mittels elektrischer Ventile und Kondensatoren in hochgespannten Gleichstrom umzuwandeln"; Zeitschrift für Physik, 4. Bd., Jan.-Mar. 1921, p. 195-205.

Schenkel, M.,: "Eine neue Schaltung für die Erzeugung hoher Gleichspannungen", Elektrotechnische Zeitschrift, Berlin, Oct. 7, 1919, 40 Jahrgang, Heft 28, pp. 333-334.

Descoeudres et al.: "DC Breakdown experiments for CLIC", Proceedings of EPAC08, EDMS Nr. 951279, CERN-TS-2008-006, Genoa, Italy p. 577, Jun. 23, 2008.

Spielrein: "Geometrisches zur elektrischen Festigkeitsrechnung", p. 78-85, Archiv für Elektrotechnik, 4(3), 1915.

Spielrein; "Geometrisches zur elektrischen Festigkeitsrechnung II", Archiv für Elektrotechnik, 1915, p. 244-254.

Rogowski et al.: "Ebene Funkenstrecke mit richtiger Randausbildung", Archiv für Elektrotechnik, XVI, Band 1926, p. 73-75.

Reinhold, G., : "Ultra-high voltage DC power supplies for large currents", Technical Report E1-72, Emil Haefeli & Co. Ltd. Basel, Switzerland, 1987.

Shima et al.: "Optimum Thickness of Carbon Stripper in Tandem Accelerator in View of Transmission", TUP053, Proceedings of the Second Asian Particle Accelerator Conference, Beijing, China, 2001, p. 731-733, 2001.

Chao et al.: "Handbook of Accelerator Physics and Engineering", World Scientific, Singapore, New Jersey, London, HongKong, 2. edition, 1999, ISBN 9-810-23500-5, 440-441.

Cockcroft et al.: "Experiments with High Velocity Positive Ions", Proc. Roy. Soc., London, 136:619, Jun. 1932, p. 619-631.

Magnus et al.: "Formulas and Theorems for the Special Functions of Mathertiatical Physics", Springer-Verlag New York Inc. 1966, Band 52,3. edition.

Abramowitz et al: "Handbook of Mathematical Functions with Formulas, Graphs, and Mathematical Tables", Dover Publications, New York, 10. edition, 1972, ISBN 486-61272-4,p. 375-499.

Bouwers, A.,: "Elektrische Höchstspannungen", Technische Physik in Einzeldarstellungen, Springer Verlag, 1939,p. 59.

Lesch, G.,: "Lehrbuch der Hochspannungstechnik", Springer Verlag, Berlin Göttingen, Heidelberg, 1959, 154-155.

Schwaiger et al.: "Elektrische Festigkeitslehre", Springer Verlag, 1925, p. 108-115, 172-173.

Biermanns: "Hochspannung und Hochleistung", Carl Hanser Verlag:, München 1949, p. 50-56.

Betz: "Konforme Abbildung", Springer-Verlag 1948, Berlin,Göttingen, Heidelberg, p. 327-344.

Ramo et al: "Fields and Waves in Communication Electronics", Wiley 3. edition, 1993, ISBN 978-0-471-58551-0, p. 264-267.

Arnold et al,: "Die Transformatoren", vol. 2 of Die Wechselstromtechnik, Springer Verlag, Berlin, 2. edition, 1921, p. 22-30.

Belchenko et al., "Initial High Voltage Tests and Beam Injection Experiments on BINP Proton Tandem-Accelerator", Proc. RUPAC, 135, 2006.

Adler et al., "Advances in the Development of the Nested High Voltage Generator", Proc. SPIE, vol. 2374, 194, 1995.

Brautti et al.; "Tubeless vacuum insulated Cockroft-Walton accelerator"; Section—A: Accelerators, Spectrometers, Detectors and Associated Equipement, Elsevier, Amsterdam, NL, Bd. A328, Nr. 1/02, Apr. 15, 2004, pp. 59-63, XP000384484; Book.

Boggia et al.; "Prototype of a tubeless vacuum insulated accelerator": Section—A: Accelerators, Sepctrometers, Detectors and Associated Equipment, Elsevier, Amsterdam, NL, Bd. 382, Nr. 1, Nov. 11, 1996, pp. 73-77; Book.

Boscolo I.; "The electronic test of the onion Cockcroft-Walton", Bd. 342, Mar. 22, 1994, pp. 309-313; Book.

Boscolo I. et al.; "A Cockcroft-Walton for Feltron: The New μ-Wave Source for TeV Colliders"; IEEE Service Center, New York, US, Bd. 39, Nr. 2 PT.02, Apr. 1, 1992, Seiten 308-314.

Schwaigier et al.: "Elektrische Festigkeitslehre", Springer Verlag, 1925, p. 108-115, 172-173.

Peck, R.A. "Characteristics of a High-Frequency Cockcroft-Walton Voltage Source, The Review of Scientific Instruments", vol. 26, No. 5, pp. 441-448, May 1955.

Auble et al.: "A Procedure for Rapid Evaluation of Carbon Stripper Foils", Nuclear Instruments and Methods Phys. Res.200 (1982), p. 13-14, North-Holland Publishing Company.

Boscolo. I., "FELTRON, A Microwave Source for High Gradient TeV Collider", INFN and University for Milan, Italy, Bourgogne Technologies, Dijon, France; pp. 1188-1191, 1991.

Boscolo, I., "A Tunable Bragg Cavity for an Efficient Millimeter FEL Driven by Electrostatic Accelerators", Applied Physics, B57, pp. 217-225, 1993.

Boseolo, I., "A 1-MW, 1-mm Continuous-Wave FELtron for Toroidal Plasma Heating", IEEE Transactions on Plasma Science, vol. 20, No. 3; pp. 256-262, Jun. 1992.

Alston, L.L., "High Voltage Technology", Oxford University Press, Lonson, ISBN 0-198-51702-5, pp. 59-94, 1968.

Cranberg, L., "The Initiation of Electrical Breakdown in Vacuum", J. Appl. Phys., 23(5), pp. 518-522, 1952.

Mulcahy, et al., "High Voltage Breakdown Study, Technical Report ECOM-0394-20", Ion Physics Corp., Burlington, MA; 84 pages, 1971.

Giere, et al., "HV Dielectric Strength of Shielding Electrods in Vacuum Circuit-Breakers, XXth Int. Symposium on Discharges and Electrical Insulation in Vacuum", Tours, IEEE, p. 119-122, 2002.

International PCT Search Report and Written Opinion, PCT/EP2011/051462, 14 pages, Feb. 2, 2011.

(56) References Cited

OTHER PUBLICATIONS

International PCT Search Report and Written Opinion, PCT/EP2011/051463, 12 pages, Feb. 2, 2011.
Japanese Office Action, Application No. 2012-512266, 6 pages, Dec. 24, 2013.
Bouwers, D., "Some New Principles in the Design of X-Ray Apparatus", Philips X-Ray Research Laboratory; Radiology; pp. 163-173. Sep. 25, 1933.
Vanoni, E., "La Progettazionne dei Circuiti Moltiplicatori ad Altissima Tension", L'Elettrotecnica, vol. XXV, No. 21; pp. 766-771. Nov. 10, 1938.
Schumann, W.O., "Fortschritte der Hochspannungstecknik", Band 1, Akademische Verlagsgesellschaft Becker & Erler Kom.-Ges., Liepzig; pp. 193-200. 1944.
Brugler, J.S., "Theoretical Performance of Voltage Multiplier Circuits", IEEE Jourcan of Solid-State Circuits; pp. 132-135. Jun. 1971.
Lin, P.M. et al., "Topological Generation and Analysis of Voltage Multiplier Circuits", IEEE Transactions on Circuits and Systems, vol. CAS-24, No. 10; pp. 517-530. Oct. 1977.
Bellar, M., et al., "Analysis of the Dynamic and Steady-State Performance of Cockcroft-Walton Cascade Rectifiers", IEEE Transactions on Power Electronics, vol. 7, No. 3; pp. 526-534. Jul. 1992.
Boscolo, I, et al., "Powerful High-Voltage Generators for FELTRON, the Electrostatic-Accelerator FEL Amplifier for TeV Colliders", Nuclear Instruments & Methods in Physics Research, vol. A318, Nos. 1/3; pp. 465-471. Jul. 1, 1992.
Malesani, L., "Theoretical Performance of the Capacitor-Diode Voltage Multiplier Fed by a Current Source", IEEE Transactions on Power Electronics; vol. 8, No. 2; pp. 147-155. Apr. 1993.
Zhang H., et al., "A Numerical Analysis Approach to Cockcroft-Walton Circuit in Electron Microscope", J. Electron Microsc. vol. 43, No. 1; pp. 25-31. 1994.
Zhang H., et al., "Efficient Compensation Method for Reducing Ripple of Cockcroft-Walton Generator in an Ultrahigh-Voltage Electron Microscope", American Institute of Physics, Rev. Sci. Instrum. 65 (10); pp. 3194-3198. Oct. 1994.
Zhang H., et al., "Transient Analysis of Cockcroft-Walton Cascade Rectifier Circuit After Load Short-Circuit", Int. J. Electronics, vol. 78, No. 5; pp. 995-1005. 1995.
Zhang H., et al., "Fundamental Harmonic of Ripples in Symmetrical Cockcroft-Walton Cascade Rectifying Circuit", American Institute of Physics, Rev. Sci. Instrum. 67 (9); pp. 3336-3337. Sep. 1996.
Kanareykin, a. et al., "Developments on a Diamond-Based Cylindrical Dielectric Accelerating Structure", Linear Colliders, Lepton Accelerators and New Acceleration Techniques; WEPLS039, Proceedings of EPAC 2006; pp. 2460-2462. 2006.
International PCT Search Report and Written Opinion, PCT/EP2010/054021, 18 pages. Mailed Oct. 15, 2010.
Japanese Office Action, Application No. 2012-512266, 4 pages, Dec. 4, 2012.

* cited by examiner

ACCELERATOR FOR CHARGED PARTICLES

CROSS-REFERENCE TO RELATED APPLICATIONS

This application is a U.S. National Stage Application of International Application No. PCT/EP2011/051462 filed Feb. 2, 2011, which designates the United States of America, and claims priority to DE Patent Application No. 10 2010 008 991.5 filed Feb. 24, 2010. The contents of which are hereby incorporated by reference in their entirety.

TECHNICAL FIELD

This disclosure relates to an accelerator for charged particles, with a capacitor stack of electrodes concentrically arranged with respect to one another, as used, in particular, in the generation of electromagnetic radiation.

BACKGROUND

Particle accelerators serve to accelerate charged particles to high energies. In addition to their importance in fundamental research, particle accelerators are becoming ever more important in medicine and for many industrial purposes.

Until now, linear accelerators and cyclotrons were used to produce a particle beam in the MV range, these usually being very complicated and complex instruments.

Such accelerators are used in free-electron lasers (FEL). A fast electron beam accelerated by the accelerator is subjected to periodic deflection in order to generate synchrotron radiation.

Such accelerators can also be used in the case of X-ray sources, in which X-ray radiation is generated by virtue of a laser beam interacting with a relativistic electron beam, as a result of which X-ray radiation is emitted as a result of inverse Compton scattering.

Another type of known particle accelerators are so-called electrostatic particle accelerators with a DC high-voltage source. Here, the particles to be accelerated are exposed to a static electric field.

By way of example, cascade accelerators (also Cockcroft-Walton accelerators) are known, in which a high DC voltage is generated by multiplying and rectifying an AC voltage by means of a Greinacher circuit, which is connected a number of times in series (cascaded), and hence a strong electric field is provided.

SUMMARY

In one embodiment, an accelerator for accelerating charged particles may include (a) a capacitor stack with a first electrode, which can be brought to a first potential, with a second electrode, which is concentrically arranged with respect to the first electrode and can be brought to a second potential that differs from the first potential, and with at least one intermediate electrode, which is concentrically arranged between the first electrode and the second electrode and which can be brought to an intermediate potential situated between the first potential and the second potential; (b) a switching device, to which the electrodes of the capacitor stack are connected and which is embodied such that, during operation of the switching device, the electrodes of the capacitor stack concentrically arranged with respect to one another can be brought to increasing potential levels; (c) a first acceleration channel, which is formed by first openings in the electrodes of the capacitor stack such that charged particles can be accelerated by the electrodes along the first acceleration channel; (d) a second acceleration channel, which is formed by second openings in the electrodes of the capacitor stack such that charged particles can be accelerated by the electrodes along the second acceleration channel; and (e) a device, by means of which it is possible to influence the accelerated particle beam in the interior of the capacitor stack, as a result of which photons that are emitted by the particle beam are created.

In a further embodiment, the device is embodied to provide a laser beam, which interacts with the accelerated particle beam such that the emitted photons emerge from inverse Compton scattering of the laser beam at the charged particles of the accelerated particle beam. In a further embodiment, the laser beam and the acceleration of the particles are tuned to one another such that the emitted photons lie in the X-ray spectrum. In a further embodiment, the device is embodied to generate a transverse magnetic field to the particle beam in order to bring about a deflection of the accelerated particle beam such that the photons are emitted from the particle beam as synchrotron radiation. In a further embodiment, the transverse magnetic field is designed to bring about a periodic deflection of the accelerated particle beam over a path in the interior of the capacitor stack. In a further embodiment, the capacitor stack comprises a plurality of intermediate electrodes concentrically arranged with respect to one another, which are connected by the switching device such that, when the switching device is in operation, the intermediate electrodes can be brought to a sequence of increasing potential levels. In a further embodiment, the electrodes of the capacitor stack are insulated from one another by the vacuum. In a further embodiment, the switching device comprises a high-voltage cascade, more particularly a Greinacher cascade or a Cockcroft-Walton cascade. In a further embodiment, the capacitor stack is subdivided into two separate capacitor chains by a gap which runs through the electrodes. In a further embodiment, the switching device comprises a high-voltage cascade, more particularly a Greinacher cascade or a Cockcroft-Walton cascade, which interconnects the two mutually separated capacitor chains and which, in particular, is arranged in the gap.

BRIEF DESCRIPTION OF THE DRAWINGS

Example embodiments will be explained in more detail below with reference to figures, in which.

DETAILED DESCRIPTION

Figure 1:
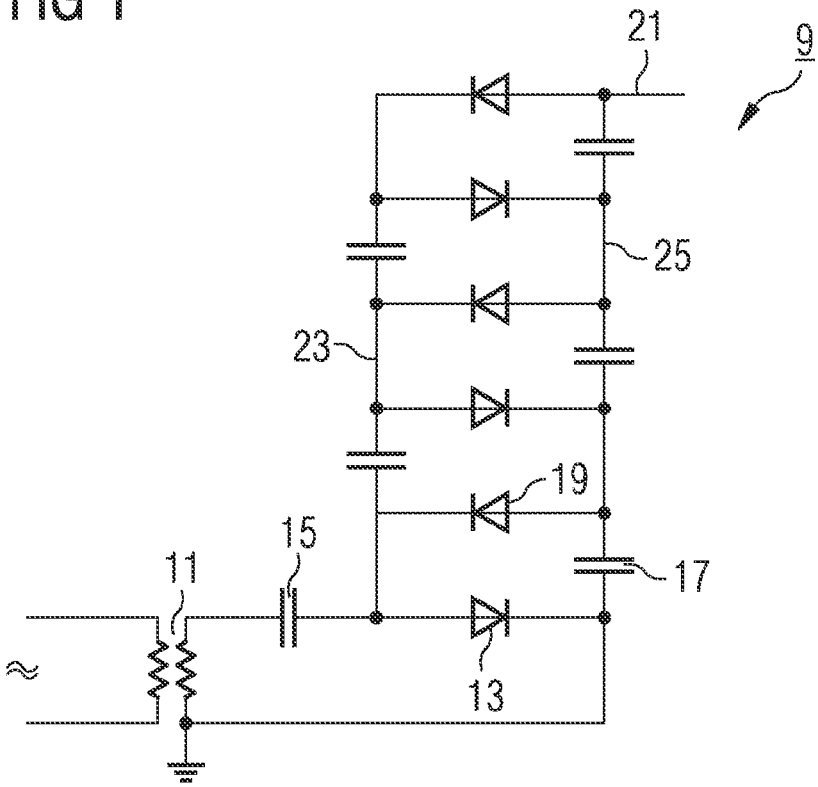
FIG. 1 shows a schematic illustration of a known Greinacher circuit.

Some embodiments provide an accelerator for accelerating charged particles, which, while having a compact design, enables particularly efficient particle acceleration to high particle energies and which, as a result thereof, can be used for generating electromagnetic radiation.

For example, in some embodiments an accelerator for accelerating charged particles comprises:

a capacitor stack

- with a first electrode, which can be brought to a first potential,
- with a second electrode, which is concentrically arranged with respect to the first electrode and can be brought to a second potential that differs from the first potential,
- with at least one intermediate electrode, which is concentrically arranged between the first electrode and the second electrode and which can be brought to an intermediate potential situated between the first potential and the second potential.

There is a switching device, to which the electrodes of the capacitor stack—i.e. the first electrode, the second electrode and the intermediate electrodes—are connected and which is embodied such that, during operation of the switching device, the electrodes of the capacitor stack concentrically arranged with respect to one another are brought to increasing potential levels.

A first acceleration channel is present, which is formed by first openings in the electrodes of the capacitor stack such that charged particles can be accelerated by the electrodes along the first acceleration channel. A second acceleration channel is also present, which is formed by second openings in the electrodes of the capacitor stack such that charged particles can be accelerated along the second acceleration channel by the electrodes.

Furthermore, a device is present, by means of which the accelerated particle beam is influenced in the interior of the capacitor stack, as a result of which photons that are emitted by the particle beam are generated. As a result of the device, an interaction with the accelerated particle beam is created, which interaction changes the energy, the speed and/or the direction of propagation. As a result of this, the electromagnetic radiation, more particularly coherent electromagnetic radiation, which emanates from the particle beam can be produced.

The capacitor stack can more particularly comprise a plurality of intermediate electrodes concentrically arranged with respect to one another, which are connected by the switching device such that, when the switching device is in operation, the intermediate electrodes are brought to a sequence of increasing potential levels between the first potential and the second potential. The potential levels of the electrodes of the capacitor stack increase in accordance with the sequence of their concentric arrangement. Here, the high-voltage electrode can be the innermost electrode in the case of the concentric arrangement, whereas the outermost electrode can be e.g. a ground electrode. An accelerating potential is formed between the first and second electrode.

Thus, the capacitor stack and the switching device constitute a DC high-voltage source because the central electrode can be brought to a high potential. The potential difference provided by the high-voltage source enables the device to be operated as an accelerator. The electric potential energy is converted into kinetic energy of the particles by virtue of applying the high potential between particle source and target. Two rows of holes bore through the concentric electrode stack.

Charged particles are provided by a source and accelerated through the first acceleration channel toward the central electrode. Subsequently, after interaction with the device in the center of the capacitor stack, e.g. within the innermost electrode, the charged particles are routed away from the central electrode through the second acceleration channel and can once again reach the outside. As a result of deceleration of the beam in the electric field, the energy expended for the acceleration is recuperated, and so very large beam currents and hence a great luminance can be obtained compared to the applied electric power.

Overall, it is possible to achieve a particle energy in the MV range in the case of a compact design and to provide a continuous beam. A source substantially situated at ground potential can for example provide negatively charged particles, which are injected as particle beam and are accelerated toward the central electrode through the first acceleration channel.

Overall, the concentric arrangement enables a compact design and, in the process, an expedient form for insulating the central electrode.

For expedient use of the insulation volume, i.e. the volume between the inner and the outer electrode, one or more concentric intermediate electrodes are brought to suitable potentials. The potential levels successively increase and can be selected such that this results in a largely uniform field strength in the interior of the entire insulation volume.

The introduced intermediate electrode(s) moreover increase the dielectric strength limit, and so higher DC voltages can be produced than without intermediate electrodes. This is due to the fact that the dielectric strength in a vacuum is approximately inversely proportional to the square root of the electrode spacings. The introduced intermediate electrode (s), by means of which the electric field in the interior of the DC high-voltage source becomes more uniform, at the same time contribute to an increase in the possible, attainable field strength.

In one embodiment, the device is embodied to provide a laser beam, which interacts with the accelerated particle beam such that the emitted photons emerge from inverse Compton scattering of the laser beam at the charged particles of the accelerated particle beam. The emitted photons are coherent. The laser beam can be obtained by forming a focus within the laser cavity.

The energy of the laser beam, the acceleration of the particles and/or the type of particles can be tuned to one another such that the emitted photons lie in the X-ray spectrum. The accelerator can thus be operated as compact coherent X-ray source.

The particle beam can be an electron beam. To this end, an electron source can be arranged e.g. outside of the outermost electrode of the capacitor stack.

In another embodiment, the device is embodied to generate a transverse magnetic field, e.g. using a dipole magnet, with respect to the direction of propagation of the particle beam. This brings about a deflection of the accelerated particle beam such that the photons are emitted from the particle beam as synchrotron radiation. As a result of this, the accelerator can as synchrotron radiation source and, more particularly, as free-electron laser by coherent superposition of the individual radiation lobes.

The device can, in particular, create a transverse magnetic field which brings about a periodic deflection of the accelerated particle beam along a path in the interior of the capacitor stack, for example by a series of dipole magnets. As a result of this, the accelerator can create coherent photons particularly efficiently.

The electromagnetic radiation emitted by the particle beam can emerge by means of a channel through the electrode stack.

In one embodiment, the electrodes of the capacitor stack are insulated from one another by vacuum insulation. As a result of this, it is possible to achieve insulation of the high-voltage electrode which is as efficient, i.e. as space-saving and robust, as possible. It follows that there is a high vacuum in the insulation volume. A use of insulating materials may be disadvantageous in that the materials tend to agglomerate internal charges which, in particular, are caused by ionizing radiation during operation of the accelerator—when exposed to an electric DC field. The agglomerated, traveling charges cause a very inhomogeneous electric field strength in all physical insulators, which then leads to the breakdown limit being exceeded locally and hence to the formation of spark channels. Insulation by a high vacuum avoids such disadvantages. The electric field strength that can be used during stable operation can be increased thereby. As a result of this, the arrangement is substantially free from insulator materials—except for a few components such as e.g. the electrode mount.

In the case of an accelerator, the use of a vacuum may be advantageous in that there is no need to provide a separate beam tube, which in turn at least in part has an insulator surface. This also prevents critical problems of the wall discharge from occurring along the insulator surfaces because the acceleration channel now no longer needs to have insulator surfaces. An acceleration channel is merely formed by openings in the electrodes which are situated in a line, one behind the other.

In one embodiment, the switching device comprises a high-voltage cascade, more particularly a Greinacher cascade or a Cockcroft-Walton cascade. By means of such a device, it is possible to charge the first electrode, the second electrode and the intermediate electrodes for generating the DC voltage by means of a comparatively low AC voltage. This embodiment is based on the concept of a high-voltage generation, as is made possible, for example, by a Greinacher rectifier cascade.

In one embodiment variant, the capacitor stack is subdivided into two mutually separate capacitor chains by a gap which runs through the electrodes. As a result of separating the concentric electrodes of the capacitor stack into two mutually separate capacitor chains, the two capacitor chains can be used for forming a cascaded switching device such as a Greinacher cascade or Cockcroft-Walton cascade. Here, each capacitor chain constitutes an arrangement of (partial) electrodes which, in turn, are concentrically arranged with respect to one another.

In an embodiment of the electrode stack as spherical shell stack, the separation can be brought about by e.g. a cut along the equator, which then leads to two hemispherical stacks.

In the case of such a circuit, the individual capacitors of the chains can be respectively charged to the peak-peak voltage of the primary input AC voltage which serves to charge the high-voltage source. The aforementioned potential equilibration, a uniform electric field distribution and hence an optimal use of the insulation clearance can be achieved in a simple manner.

The switching device, which comprises a high-voltage cascade, can interconnect the two mutually separated capacitor chains and, in particular, be arranged in the gap. The input AC voltage for the high-voltage cascade can be applied between the two outermost electrodes of the capacitor chains because, for example, these can be accessible from the outside. The diode chains of a rectifier circuit can then be applied in the equatorial gap—and hence in a space-saving manner.

The electrodes of the capacitor stack can be formed such that they are situated on the surface of an ellipsoid, more particularly on the surface of a sphere, or on the surface of a cylinder. These shapes are physically expedient. Selecting the shape of the electrodes as in the case of a hollow sphere or the spherical capacitor is particularly expedient. Similar shapes such as e.g. in the case of a cylinder are also possible, wherein the latter however usually has a comparatively inhomogeneous electric field distribution.

The low inductance of the shell-like potential electrodes allows the application of high operating frequencies, and so the voltage reduction during the current drain remains restricted despite relatively low capacitance of the individual capacitors.

The principle of a high-voltage cascade 9, which is configured as per a Greinacher circuit, should be clarified using the circuit diagram in FIG. 1.

Figure 2:
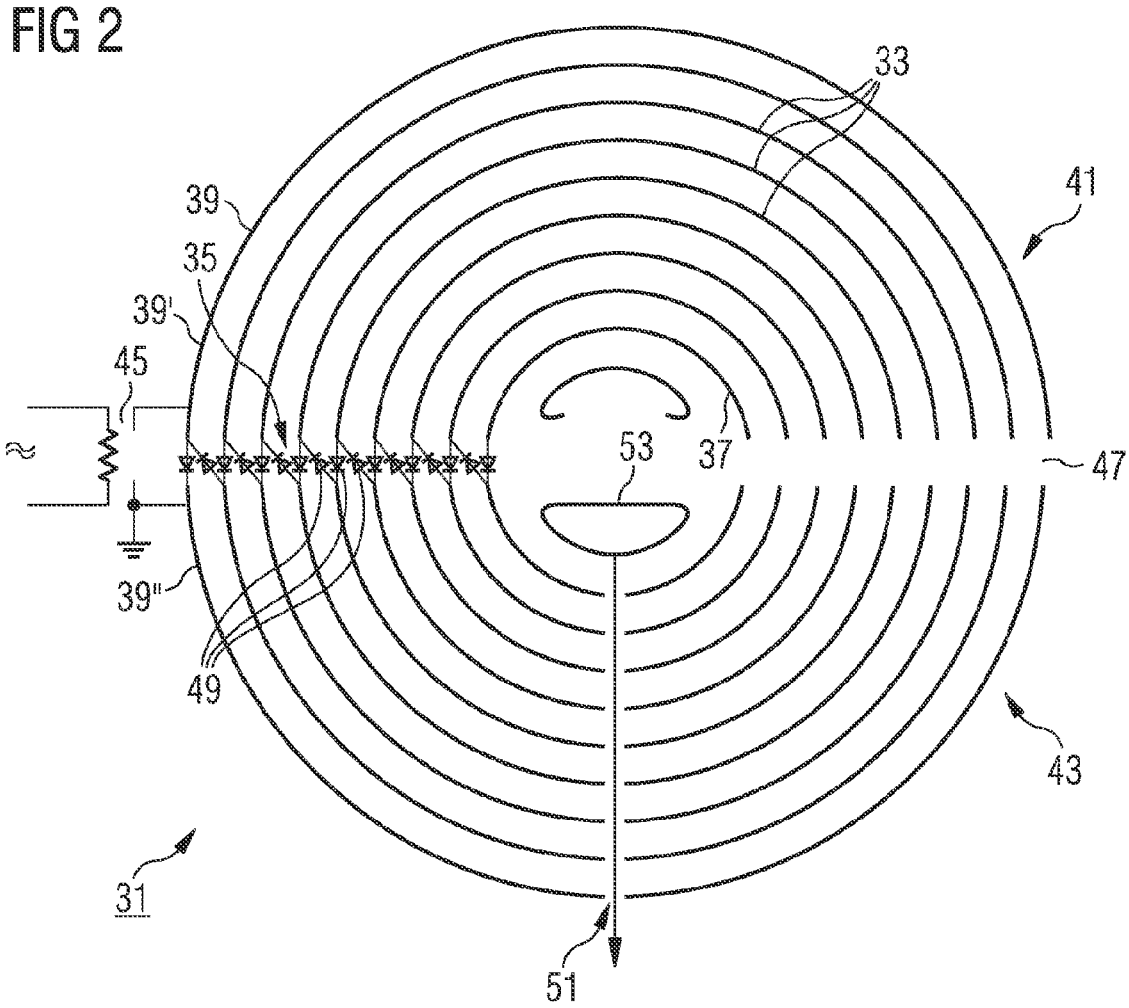
FIG. 2 shows a schematic illustration of a section through a DC high-voltage source with a particle source in the center.

An AC voltage U is applied to an input 11. The first half-wave charges the capacitor 15 to the voltage U via the diode 13. In the subsequent half-wave of the AC voltage, the voltage U from the capacitor 13 is added to the voltage U at the input 11, such that the capacitor 17 is now charged to the voltage 2U via the diode 19. This process is repeated in the subsequent diodes and capacitors, and so the voltage 6U is obtained in total at the output 21 in the case of the circuit shown in FIG. 1. FIG. 2 also clearly shows how, as a result of the illustrated circuit, the first set 23 of capacitors respectively forms a first capacitor chain and the second set 25 of capacitors respectively forms a second capacitor chain.

FIG. 2 shows a schematic section through a high-voltage source 31 with a central electrode 37, an outer electrode 39 and a row of intermediate electrodes 33, which are interconnected by a high-voltage cascade 35, the principle of which was explained in FIG. 1, and which can be charged by this high-voltage cascade 35.

The electrodes 39, 37, 33 are embodied in the form of a hollow sphere and arranged concentrically with respect to one another. The maximum electric field strength that can be applied is proportional to the curvature of the electrodes. Therefore, a spherical shell geometry is particularly expedient.

Situated in the center there is the high-voltage electrode 37; the outermost electrode 39 can be a ground electrode. As a result of an equatorial cut 47, the electrodes 37, 39, 33 are subdivided into two mutually separate hemispherical stacks which are separated by a gap. The first hemispherical stack forms a first capacitor chain 41 and the second hemispherical stack forms a second capacitor chain 43.

In the process, the voltage U of an AC voltage source 45 is respectively applied to the outermost electrode shell halves 39', 39". The diodes 49 for forming the circuit are arranged in the region of the great circle of halves of the hollow spheres, i.e. in the equatorial cut 47 of the respective hollow spheres.

The diodes 49 form the cross-connections between the two capacitor chains 41, 43, which correspond to the two sets 23, of capacitors from FIG. 1.

In the case of the high-voltage source 31 illustrated here, an acceleration channel 51, which runs from e.g. a particle source 53 arranged in the interior and enables the particle beam to be extracted, is routed through the second capacitor chain 43. The particle stream of charged particles experiences a high acceleration voltage from the hollow-sphere-shaped high-voltage electrode 37.

The high-voltage source 31 or the particle accelerator may be advantageous in that the high-voltage generator and the particle accelerator are integrated into one another because in this case all electrodes and intermediate electrodes can be housed in the smallest possible volume.

In order to insulate the high-voltage electrode 37, the whole electrode arrangement is insulated by vacuum insulation. Inter alia, this affords the possibility of generating particularly high voltages of the high-voltage electrode 37, which results in a particularly high particle energy. However, in principle, insulating the high-voltage electrode by means of solid or liquid insulation is also conceivable.

The use of vacuum as an insulator and the use of an intermediate electrode spacing of the order of 1 cm affords the possibility of achieving electric field strengths with values of more than 20 MV/m. Moreover, the use of a vacuum may eliminate the need for the accelerator to operate at low load during operation due to the radiation occurring during the acceleration possibly leading to problems in insulator materials. This may allow the design of smaller and more compact machines.

Figure 3:
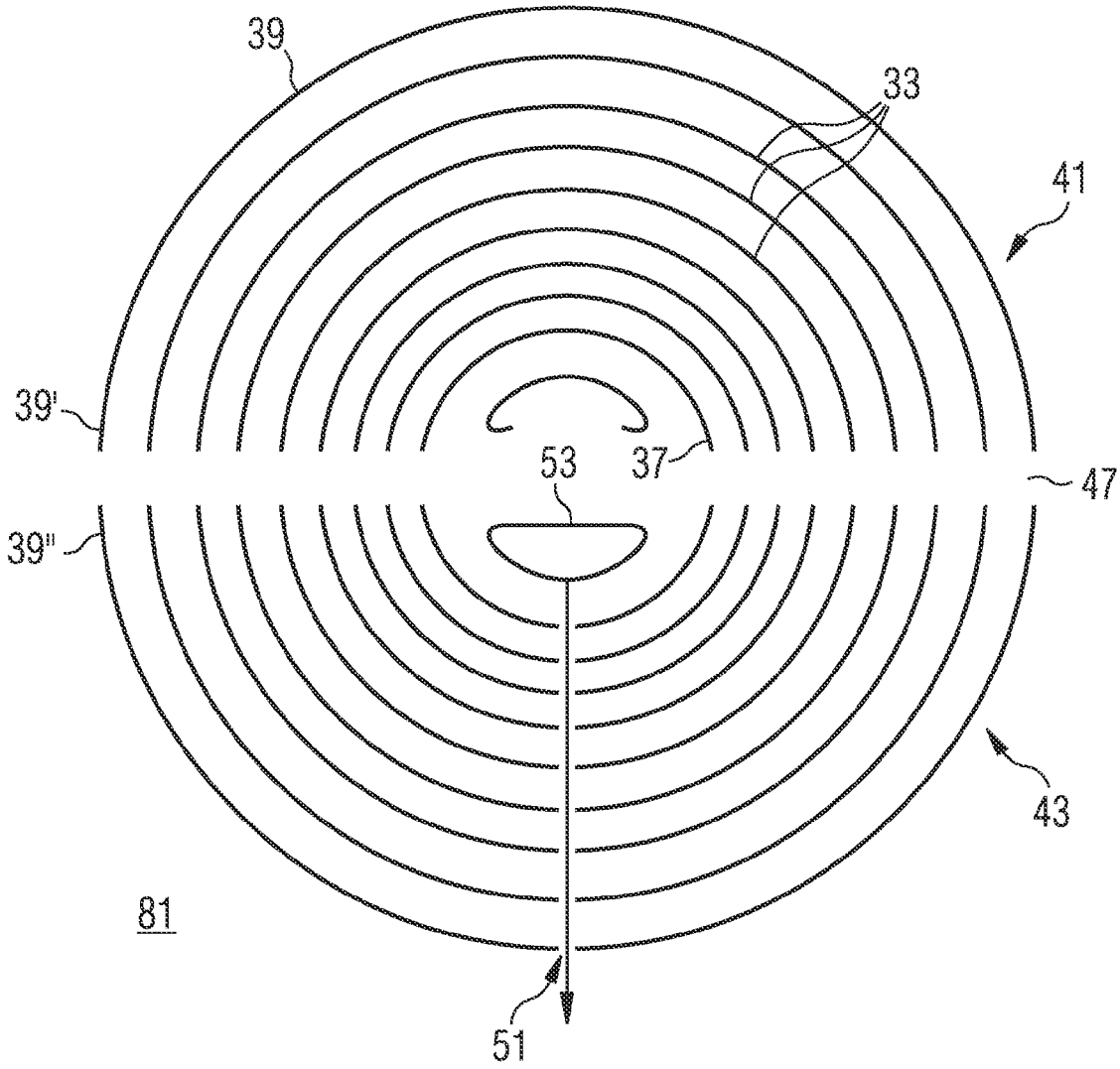
FIG. 3 shows a schematic illustration of a section through a DC high-voltage source according to FIG. 2, with an electrode spacing decreasing toward the center.

FIG. 3 shows a development of the high-voltage source shown in FIG. 2, in which the spacing of the electrodes 39, 37, 33 decreases toward the center. As a result of such an embodiment, it is possible to compensate for the decrease of the pump AC voltage, applied to the outermost electrode 39, toward the center such that a substantially identical field strength nevertheless prevails between adjacent electrode pairs. As a result of this, it is possible to achieve a largely constant field strength along the acceleration channel 51. This embodiment can likewise be applied to the applications and embodiments explained below.

Figure 4:
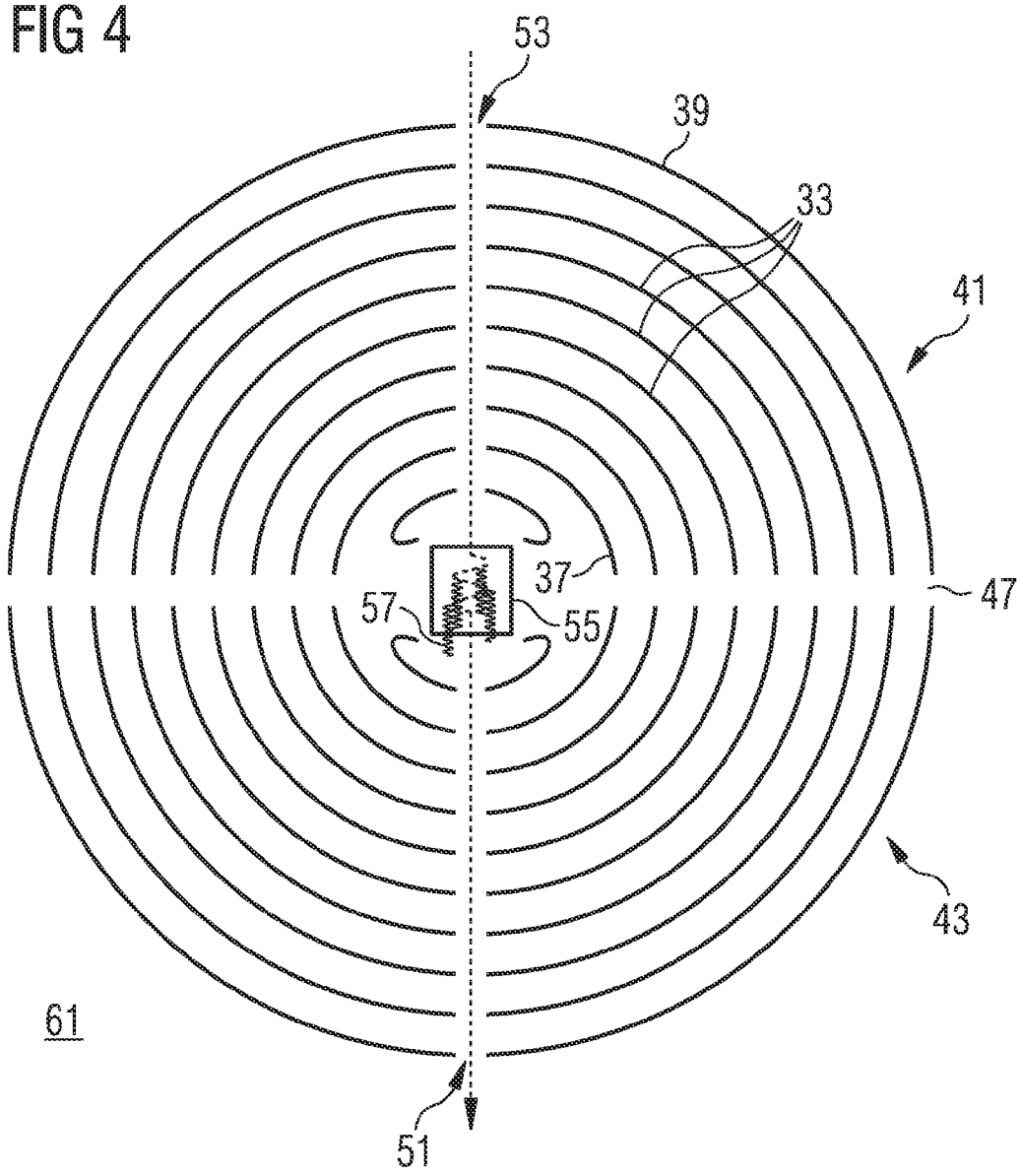
FIG. 4 shows a schematic illustration of a section through a DC high-voltage source which is embodied as free-electron laser.

FIG. 4 shows a development of the high-voltage source shown in FIG. 2 as a free-electron laser 61. The circuit device 35 from FIG. 2 is not illustrated for reasons of clarity, but is identical in the case of the high-voltage source shown in FIG. 4. The design can likewise have an electrode spacing which decreases toward the center, as shown in FIG. 3.

In the example illustrated here, the first capacitor chain 41 also has an acceleration channel 53 which is routed through the electrodes 33, 37, 39.

In place of the particle source, a magnet device 55 is arranged in the interior of the central high-voltage electrode 37 and it can be used to deflect the particle beam periodically. It is then possible to produce electrons outside of the high-voltage source 61, which electrons are accelerated through the first capacitor chain 41 toward the central high-voltage electrode 37 along the acceleration channel 53. Coherent synchrotron radiation 57 is created when passing through the magnet device 55 and the accelerator can be operated as a free-electron laser 61. The electron beam is decelerated again by the acceleration channel 51 of the second capacitor chain 43 and the energy expended for acceleration can be recuperated.

The outermost spherical shell 39 can remain largely closed and thus assume the function of a grounded housing.

The hemispherical shell situated directly therebelow can then be the capacitor of an LC resonant circuit and part of the drive connector of the switching device.

For such a type of acceleration, the accelerator can provide a 10 MV high-voltage source with N=50 levels, i.e. a total of 100 diodes and capacitors. In the case of an inner radius of r=0.05 m and a vacuum insulation with a dielectric strength of 20 MV/m, the outer radius is 0.55 m. In each hemisphere there are 50 intermediate spaces with a spacing of 1 cm between adjacent spherical shells.

A smaller number of levels reduces the number of charge cycles and the effective internal source impedance, but increases the demands made on the pump charge voltage.

The diodes arranged in the equatorial gap, which interconnect the two hemisphere stacks can, for example, be arranged in a spiral-like pattern. According to equation (3.4), the total capacitance can be 74 pF and the stored energy can be 3.7 kJ. A charge current of 2 mA requires an operating frequency of approximately 100 kHz.

Figure 5:
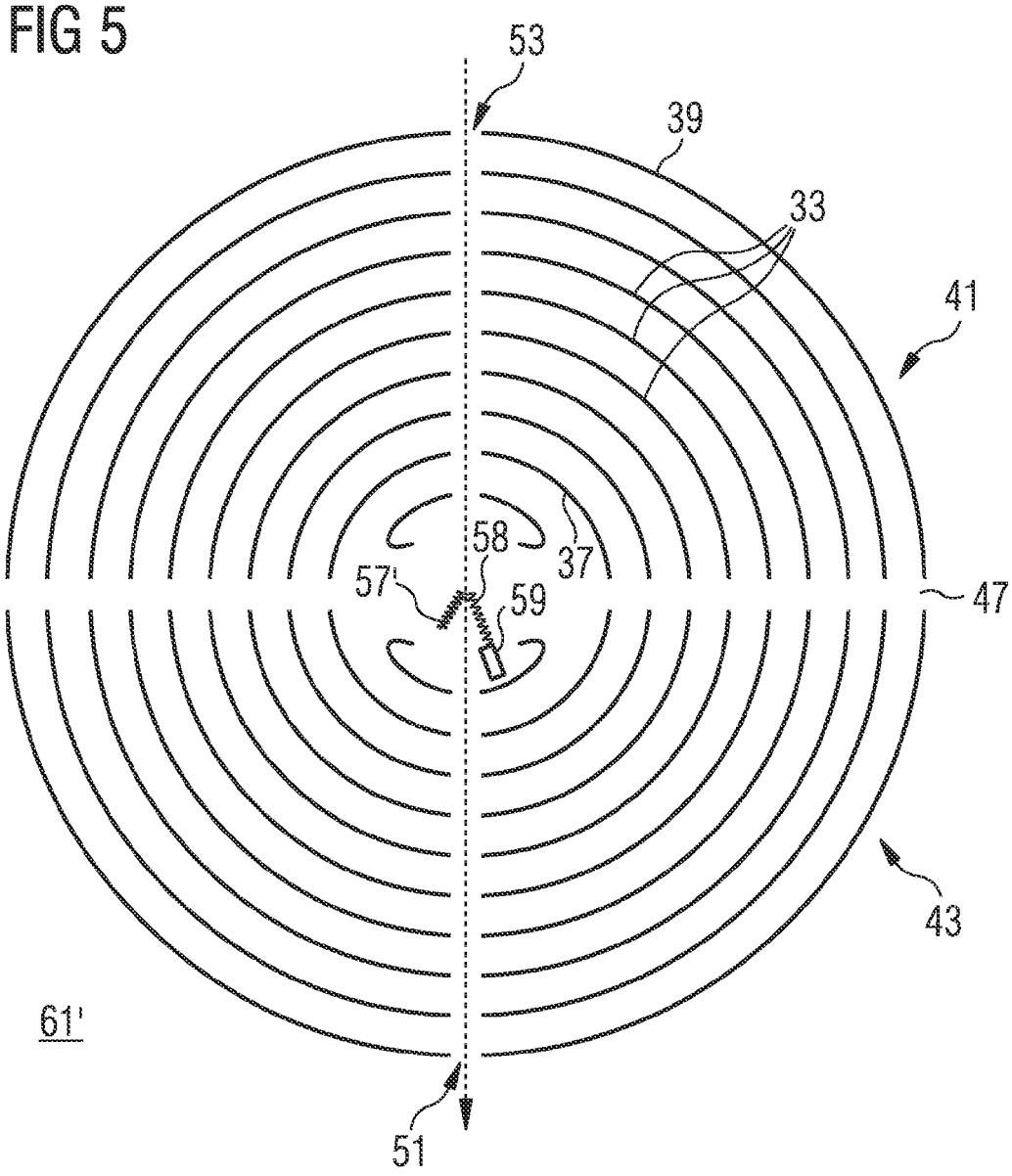
FIG. 5 shows a schematic illustration of a section through a DC high-voltage source which is embodied as coherent X-ray source.

FIG. 5 shows a development of the accelerator, shown in FIG. 4, for of a source 61' for coherent X-ray radiation.

In place of the particle source, a laser device 59 is arranged in the interior of the central high-voltage electrode 37 and it can be used to generate a laser beam 58 and direct the latter onto the particle beam. As a result of interaction with the particle beam, photons 57' are created as a result of inverse Compton scattering, which photons are emitted by the particle beam.

Figure 6:
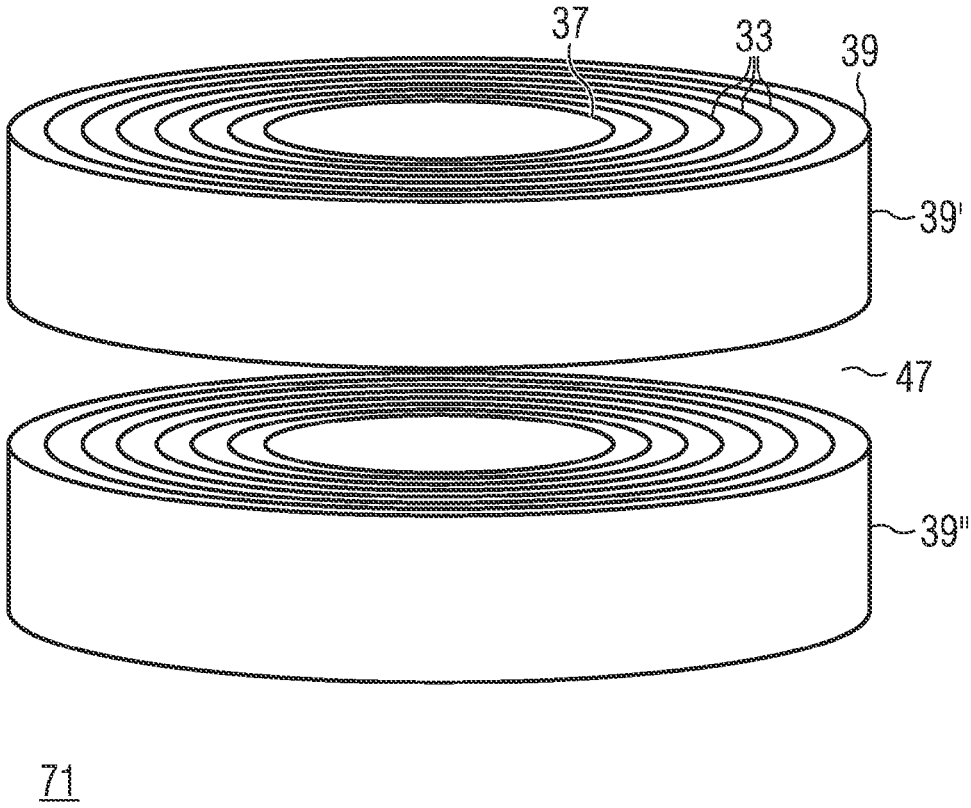
FIG. 6 shows a schematic illustration of the electrode design with a stack of cylindrically arranged electrodes.

FIG. 6 illustrates an electrode form in which hollow-cylinder-shaped electrodes 33, 37, 39 are arranged concentrically with respect to one another. A gap divides the electrode stack into two mutually separate capacitor chains, which can be connected by a switching device with a configuration analogous to the one in FIG. 2.

Figure 7:
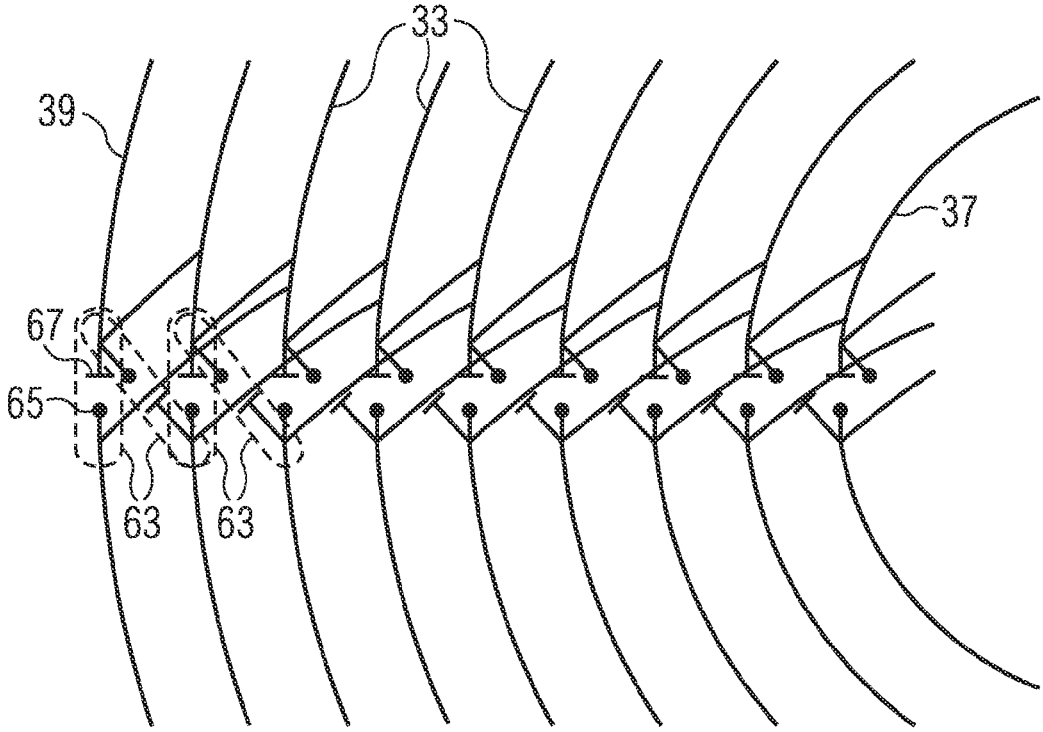
FIG. 7 shows an illustration of the diodes of the switching device, which diodes are embodied as vacuum-flask-free electron tubes.

FIG. 7 shows a shown embodiment of the diodes of the switching device. The concentrically arranged, hemisphere-shell-like electrodes 39, 37, 33 are only indicated in the illustration for reasons of clarity.

In this case, the diodes are shown as electron tubes 63, with a cathode 65 and an anode 67 opposite thereto. Since the switching device is arranged within the vacuum insulation, the vacuum flask of the electron tubes, which would otherwise be required for operating the electrodes, can be dispensed with. The electron tubes 63 can be controlled by thermal heating or by light.

In the following text, more detailed explanations will be offered in respect of components of the high-voltage source or in respect of the particle accelerator.

Spherical Capacitor

The arrangement follows the principle shown in FIG. 1 of arranging the high-voltage electrode in the interior of the accelerator and the concentric ground electrode on the outside of the accelerator.

A spherical capacitor with an inner radius r and an outer radius R has a capacitance given by $$C = 4\pi\epsilon_0 \frac{rR}{R-r}. \tag{3.1}$$

The field strength at a radius ρ is then given by (3.2)

$$E = \frac{rR}{(R-r)\rho^2} U \tag{3.2}$$

This field strength has a quadratic dependence on the radius and therefore increases strongly toward the inner electrode. At the inner electrode surface ρ=r, the maximum $$\hat{E} = \frac{R}{r(R-r)}U \tag{3.3}$$

has been attained. This may be disadvantageous from the point of view of the dielectric strength.

A hypothetical spherical capacitor with a homogeneous electric field would have the following capacitance:

$$\overline{C} = 4\pi\epsilon_0 \frac{R^2 + rR + r^2}{R-r}. \tag{3.4}$$

As a result of the fact that the electrodes of the capacitors of the Greinacher cascade have been inserted as intermediate electrodes at a clearly defined potential in the cascade accelerator, the field strength distribution is linearly fitted over the radius because, for thin-walled hollow spheres, the electric field strength approximately equals the flat case $$E \to \frac{U}{(R-r)}. \tag{3.5}$$

with minimal maximum field strength.

The capacitance between two adjacent intermediate electrodes is given by $$C_k = 4\pi\epsilon_0 \frac{r_k r_{k+1}}{r_{k+1} - r_k}. \tag{3.6}$$

Hemispherical electrodes and equal electrode spacing d=(R−r)/N leads to $r_k$=r+kd and to the following electrode capacitances:

$$C_{2k} = C_{2k+1} = 2\pi\epsilon_0 \frac{r^2 + rd + (2rd + d^2)k + d^2k^2}{d}. \tag{3.7}$$

Rectifier

Modern soft avalanche semiconductor diodes have very low parasitic capacitances and have short recovery times. A connection in series requires no resistors for equilibrating the potential. The operating frequency can be selected to be comparatively high in order to use the relatively small inter-electrode capacitances of the two Greinacher capacitor stacks.

In the case of a pump voltage for charging the Greinacher cascade, it is possible to use a voltage of $U_{in}$≈100 kV, i.e. 70 $kV_{eff}$. The diodes must withstand voltages of 200 kV. This can be achieved by virtue of the fact that use is made of chains of diodes with a lower tolerance. By way of example, use can be made of ten 20 kV diodes. By way of example, diodes can be BY724 diodes by Philips, BR757-200A diodes by EDAL or ESJA5320A diodes by Fuji.

Fast reverse recovery times, e.g. $t_{rr}$≈100 ns for BY724, minimize losses. The dimensions of the BY724 diode of 2.5 mm×12.5 mm make it possible to house all 1000 diodes for the switching device in a single equatorial plane for the spherical tandem accelerator specified in more detail below.

In place of solid-state diodes, it is also possible to use electron tubes in which the electron emission is used for rectification. The chain of diodes can be formed by a multiplicity of electrodes, arranged in a mesh-like fashion with respect to one another, of the electron tubes, which are connected to the hemispherical shells. Each electrode acts as a cathode on one hand and as an anode on the other hand.

Discrete Capacitor Stack

The central concept includes cutting through the electrodes, which are concentrically arranged in succession, on an equatorial plane. The two resultant electrode stacks constitute the cascade capacitors. All that is required is to connect the chain of diodes to opposing electrodes over the plane of the cut. It should be noted that the rectifier automatically stabilizes the potential differences of the successively arranged electrodes to approximately 2 $U_{in}$, which suggests constant electrode spacings. The drive voltage is applied between the two outer hemispheres.

Ideal Capacitance Distribution

If the circuit only contains the capacitors from FIG. 3, the stationary operation supplies an operating frequency f, a charge $$Q = \frac{I_{out}}{f} \tag{3.8}$$

per full wave in the load through the capacitor $C_0$. Each of the capacitor pairs $C_{2k}$ and $C_{2k+1}$ therefore transmits a charge (k+1)Q.

The charge pump represents a generator-source impedance $$R_C = \frac{1}{2f}\sum_{k=0}^{N-1}\left(\frac{2k^2+3k+1}{C_{2k}} + \frac{2k^2+4k+2}{C_{2k+1}}\right) \tag{3.9}$$

As a result, a load current $I_{out}$ reduces the DC output voltage as per $$U_{out}=2NU_{in}-R_G I_{out}. \tag{3.10}$$

The load current causes a residual AC ripple at the DC output with the peak-to-peak value of $$\delta U = \frac{I_{out}}{f}\sum_{k=0}^{N-1}\frac{k+1}{C_{2k}}. \tag{3.11}$$

If all capacitors are equal to $C_k$=C, the effective source impedance is $$R_G = \frac{8N^3 + 9N^2 + N}{12fC} \tag{3.12}$$

and the peak-to-peak value of the AC ripple becomes $$\delta U = \frac{I_{out}}{fC}\frac{N^2+N}{2}. \tag{3.13}$$

For a given total-energy store within the rectifier, a capacitive inequality slightly reduces the values $R_G$ and $R_R$ compared to the conventional selection of identical capacitors in favor of the low-voltage part.

FIG. 7 shows the charging of an uncharged cascade of N=50 concentric hemispheres, plotted over the number of pump cycles.

Leakage Capacitances

Any charge exchange between the two columns reduces the efficiency of the multiplier circuit, see FIG. 1, e.g. as a result of the leakage capacitances $c_j$ and the reverse recovery charge losses $q_j$ by the diodes $D_j$.

The basic equations for the capacitor voltages $U_k^{\pm}$ at the positive and negative extrema of the peak drive voltage U, with the diode forward voltage drop being ignored, are:

$$U_{2k}^{+}=u_{2k+1} \tag{3.14}$$

$$U_{2k}^{-}=u_{2k} \tag{3.15}$$

$$U_{2k+1}^{+}=u_{2k+1} \tag{3.16}$$

$$U_{2k+1}^{-}=u_{2k+2} \tag{3.17}$$

up to the index 2N−2 and $$U_{2N-1}^{+}=u_{2N-1}-U \tag{3.18}$$

$$U_{2N-1}^{-}=U. \tag{3.19}$$

Using this nomenclature, the mean amplitude of the DC output voltage is $$U_{out}=\frac{1}{2}\sum_{k=0}^{2N-1}u_k. \tag{3.20}$$

The peak-to-peak value of the ripple in the DC voltage is $$\delta U=\sum_{k=0}^{2N-1}(-1)^{k+1}u_k. \tag{3.21}$$

With leakage capacitances $c_i$ parallel to the diodes $D_i$, the basic equations for the variables are $u_{-1}=0$, $U_{2N}=2U$, and the tridiagonal system of equations is $$C_{k-1}u_{k-1}-(C_{k-1}+C_k)u_k+(C_k-c_k)u_{k+1}=\begin{cases}Q & \forall k \text{ even}\\ 0 & \forall k \text{ odd.}\end{cases} \tag{3.22}$$

Reverse Recovery Charges

Finite reverse recovery times $t_{rr}$ of the delimited diodes cause a charge loss of $$qD=\eta QD \tag{3.23}$$

with $\eta=f t_{rr}$ and $Q_D$ for the charge per full wave in the forward direction. Equation (3.22) then becomes:

$$C_{k-1}u_{k-1}-(C_{k-1}+(1-n)C_k)u_k+((1-n)C_k-c_k)u_{k+1}=\begin{cases}Q & \forall k \text{ even}\\ 0 & \forall k \text{ odd.}\end{cases} \tag{3.24}$$

Continuous Capacitor Stack

Capacitive Transmission Line

In Greinacher cascades, the rectifier diodes substantially take up the AC voltage, convert it into DC voltage and accumulate the latter to a high DC output voltage. The AC voltage is routed to the high-voltage electrode by the two capacitor columns and damped by the rectifier currents and leakage capacitances between the two columns.

For a large number N of levels, this discrete structure can be approximated by a continuous transmission-line structure.

For the AC voltage, the capacitor design constitutes a longitudinal impedance with a length-specific impedance 3. Leakage capacitances between the two columns introduce a length-specific shunt admittance $\mathfrak{Y}$. The voltage stacking of the rectifier diodes brings about an additional specific current load $\mathfrak{I}$, which is proportional to the DC load current $I_{out}$ and to the density of the taps along the transmission line.

The basic equations for the AC voltage U(x) between the columns and the AC direct-axis current I(X) are $$I'=\mathfrak{Y}U+\mathfrak{I} \tag{3.25}$$

$$U'=3I. \tag{3.26}$$

The general equation is an extended telegraph equation:

$$U''-\frac{3'}{3}U'-3\mathfrak{Y}U=3\mathfrak{I}. \tag{3.27}$$

In general, the peak-to-peak ripple at the DC output equals the difference of the AC voltage amplitude at both ends of the transmission line.

$$\delta U=U(x_0)-U(x_1). \tag{3.28}$$

Two boundary conditions are required for a unique solution to this second-order differential equation.

One of the boundary conditions can be $U(x_0)=U_{in}$, given by the AC drive voltage between the DC low-voltage ends of the two columns. The other natural boundary condition determines the AC current at the DC high-voltage end $x=x_1$. The boundary condition for a concentrated terminal AC impedance $Z_1$ between the columns is:

$$U'(x_1)=\frac{3(x_1)}{Z_1}U(x_1). \tag{3.29}$$

In the unloaded case $Z_1=\infty$, the boundary condition is $U'(x_1)=0$.

Constant Electrode Spacing

For a constant electrode spacing t, the specific load current is $$\mathfrak{I}=\frac{i\pi I_{out}}{t}, \tag{3.30}$$

and so the distribution of the AC voltage is regulated by $$U''-\frac{3'}{3}U'-3\mathfrak{Y}U=3\mathfrak{I}. \tag{3.31}$$

The average DC output voltage then is $$U_{out} = \frac{2U_{in}}{t}\int_0^{Nt} U(x)dx \tag{3.32}$$

and the DC peak-to-peak ripple of the DC-voltage is $$\delta U = U(Nt) - U(0). \tag{3.33}$$

Optimal Electrode Spacing

The optimal electrode spacing ensures a constant electric DC field strength 2 E in the case of the planned DC load current. The specific AC load current along the transmission line, depending on the position, is $$\mathfrak{J} = \frac{i\pi E I_{out}}{U}. \tag{3.34}$$

The AC voltage follows from $$UU'' - \frac{3'}{3}UU' - 3\mathfrak{J}U^2 = 3i\pi E I_{out}. \tag{3.35}$$

The electrode spacings emerge from the local AC voltage amplitudes t(x)=U(x)/E.

The DC output voltage in the case of the planned DC load current is $U_{out}$=2Ed. A reduction in the load always increases the voltages between the electrodes; hence operation with little or no load can exceed the admissible E and the maximum load capacity of the rectifier columns. It can therefore be recommendable to optimize the design for unloaded operation.

For any given electrode distribution that differs from the one in the configuration for a planned DC load current, the AC voltage along the transmission line and hence the DC output voltage is regulated by equation (3.27).

Linear Cascade

In the case of a linear cascade with flat electrodes with the width w, height h and a spacing s between the columns, the transmission line impedances are $$3 = \frac{2}{i\epsilon_0 w wh}, \quad \mathfrak{J} = \frac{i\epsilon_0 w w}{s}. \tag{3.36}$$

Linear Cascade—Constant Electrode Spacing

The inhomogeneous telegraph equation is $$U'' - \frac{2}{hs}U = \frac{I_{out}}{f\epsilon_0 wht}. \tag{3.37}$$

Under the assumption of a line which extends from x=0 to x=d=Nt and is operated by $U_{in}$=U (0), and of a propagation constant of $\gamma^2$=2/(h*s), the solution is $$U(x) = \frac{\cosh\gamma x}{\cosh\gamma d}U_{in} + \left(\frac{\cosh\gamma x}{\cosh\gamma d} - 1\right)\frac{N_s}{2f\epsilon_0 dw}I_{out}. \tag{3.38}$$

The diodes substantially tap the AC voltage, rectify it immediately and accumulate it along the transmission line. Hence, the average DC output voltage is $$U_{out} = \frac{2}{t}\int_0^d U(x)dx. \tag{3.39}$$

or—explicitly—

$$U_{out} = 2N\frac{\tanh\gamma d}{\gamma d}U_{in} + \left(\frac{\tanh\gamma d}{\gamma d} - 1\right)\frac{N^2 s}{f\epsilon_0 dw}I_{out}. \tag{3.40}$$

A series expansion up to the third order in γd results in $$U_{out} \approx 2NU_{in}\left(1 - \frac{2d^2}{3hs}\right) - \frac{2N^2}{3f}\frac{d}{\epsilon_0 hw}I_{out} \tag{3.41}$$

and $$\delta U \approx \frac{d^2}{hs}U_{in} + \frac{N}{f}\frac{d}{\epsilon_0 hw}I_{out}. \tag{3.42}$$

The load-current-related effects correspond to equation (3.12) and (3.13).

Linear Cascade—Optimal Electrode Spacing

In this case, the basic equation is $$UU'' = \frac{2}{hs}U^2 = \frac{EI_{out}}{f\epsilon_0 wh}. \tag{3.43}$$

It appears as if this differential equation has no closed analytical solution. The implicit solution which satisfies U'(0) =0 is $$x = \int_{U(U)}^{U(x)} \frac{du}{\sqrt{\frac{2}{hs}(u^2 - U^2(0)) + \frac{EI_{out}}{f\epsilon_0 wh}\log\frac{u}{U(0)}}}. \tag{3.44}$$

Radial Cascade

Under the assumption of a stack of concentric cylinder electrodes with a radius-independent height h and an axial gap between the columns as shown in FIG. 4, the radial-specific impedances are $$3 = \frac{1}{i\pi\epsilon_0 wrh}, \quad \mathfrak{J} = \frac{2i\pi\epsilon_0 wr}{s}. \tag{3.45}$$

Radial Cascade—Constant Electrode Spacing

With an equidistant radial electrode spacing t=(R−r)/N, the basic equation $$U'' + \frac{1}{\rho}U' - \frac{2}{hs}U = \frac{I_{out}}{\epsilon_0 whtp} \tag{3.46}$$

has the general solution $$U(\rho) = AK_0(\gamma\rho) + BI_0(\gamma\rho) + \frac{I_{out}}{4\gamma f \epsilon_0 ht} L_0(\gamma\rho), \tag{3.47}$$

with $\gamma^2=2/(h*s)$. $K_0$ and $I_0$ are the modified zeroth-order Bessel functions and $L_0$ is the modified zeroth-order STRUVE function $L_0$.

The boundary conditions U' (r)=0 at the inner radius r and U (R)=$U_{in}$ at the outer radius R determine the two constants $$A = \frac{U_{in} I_1(\gamma r) - \frac{I_{out}}{4\gamma f \epsilon_0 ht}\left[I_1(\gamma r)L_0(\gamma R) - I_0(\gamma R)\left(L_1(\gamma r) + \frac{2}{\pi}\right)\right]}{I_0(\gamma R)K_1(\gamma r) + I_1(\gamma r)K_0(\gamma R)} \tag{3.48}$$

$$B = \frac{U_{in} K_1(\gamma r) - \frac{I_{out}}{4\gamma f \epsilon_0 ht}\left[K_1(\gamma r)L_0(\gamma R) + K_0(\gamma R)\left(L_1(\gamma r) + \frac{2}{\pi}\right)\right]}{I_0(\gamma R)K_1(\gamma r) + I_1(\gamma r)K_0(\gamma R)} \tag{3.49}$$

such that $$U(\rho) = U_{in}\frac{I_0(\gamma\rho)K_1(\gamma r) + I_1(\gamma r)K_0(\gamma\rho)}{I_0(\gamma R)K_1(\gamma r) + I_1(\gamma r)K_0(\gamma R)} + \frac{I_{out}}{4\gamma f \epsilon_0 ht}\left[L_0(\gamma\rho) - L_0(\gamma R)\frac{I_0(\gamma\rho)K_1(\gamma r) + I_1(\gamma r)K_0(\gamma)}{I_0(\gamma R)K_1(\gamma r) + I_1(\gamma r)K_0(\gamma R)} - \left(L_1(\gamma r) + \frac{2}{\pi}\right)\frac{I_0(\gamma\rho)K_0(\gamma R) - I_0(\gamma R)K_0(\gamma\rho)}{I_0(\gamma R)K_1(\gamma r) + I_1(\gamma r)K_0(\gamma R)}\right]. \tag{3.50}$$

$K_1$ and $I_I$ are the modified Bessel functions and $L_1$ is the modified Struve function $L_1=L'_0-2/\pi$, all of first order.

The DC output voltage is $$U_{out} = \frac{2}{t}\int_r^k U(\rho)d\rho. \tag{3.51}$$

Radial Cascade—Optimal Electrode Spacing

The optimal local electrode spacing is t(ρ)=U(ρ)/E and the basic equation becomes $$UU'' + \frac{1}{\rho}UU' - \frac{2}{hs}U^2 = \frac{EI_{out}}{\epsilon_0 whp} \tag{3.52}$$

It appears as if this differential equation has no closed analytical solution, but it can be solved numerically.

Electrode Shapes

Equipotential Surfaces

A compact machine requires the dielectric field strength to be maximized. Generally smooth surfaces with small curvature should be selected for the capacitor electrodes. As a rough approximation, the dielectric strength E scales with the inverse square root of the electrode spacing, and so a large number of closely spaced apart equipotential surfaces with smaller voltage differences should be preferred over a few large distances with large voltage differences.

Minimal E-Field Electrode Edges

Figure 8:
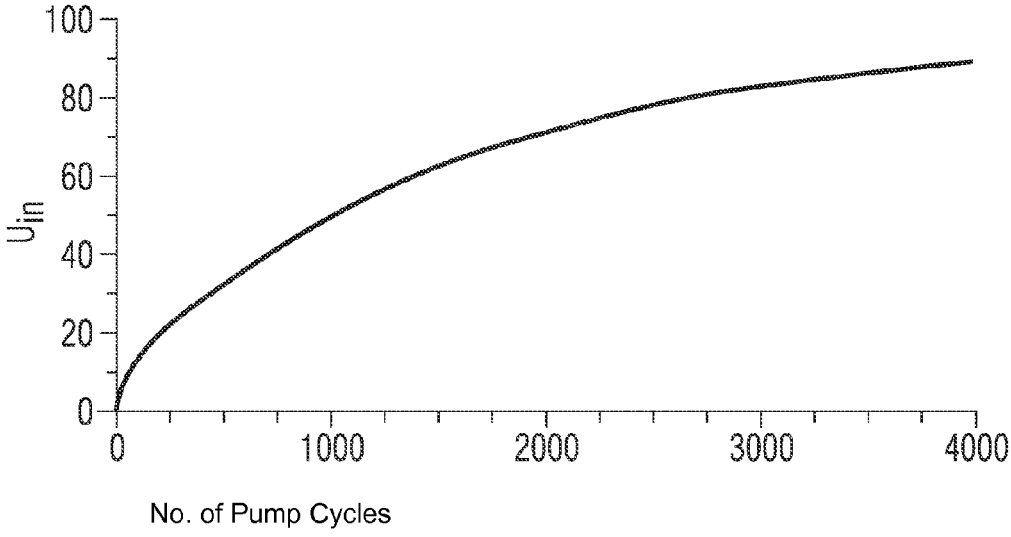
FIG. 8 shows a diagram showing the charging process as a function of pump cycles.
Figure 9:
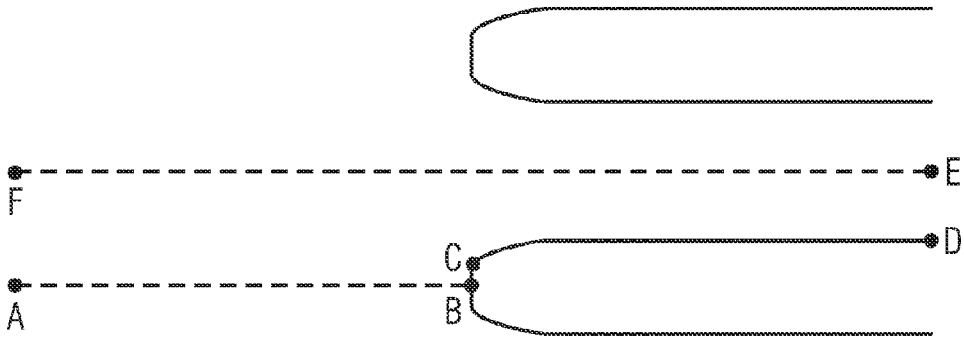
FIG. 9 shows a Kirchhoff-form of the electrode ends.

For a substantially planar electrode design with equidistant spacing and a linear voltage distribution, the optimal edge-shape is known as KIRCHHOFF form (see below), $$x = \frac{A}{2\pi}\ln\frac{1+\cos\vartheta}{1-\cos\vartheta} - \frac{1+A^2}{4\pi}\ln\frac{1+2A\cos\vartheta+A^2}{1-2A\cos\vartheta+A^2} \tag{3.53}$$

$$y = \frac{b}{2} + \frac{1-A^2}{2\pi}\left(\arctan\frac{2A}{1-A^2} - \arctan\frac{2A\sin\vartheta}{1-A^2}\right). \tag{3.54}$$

pendent on the parameters θ∈[0, π/2]. The electrode shape is shown in FIG. 8. The electrodes have a normalized distance of one and an asymptotic thickness 1−A at a great distance from the edge which, at the end face, tapers to a vertical edge with the height $$b = 1 - A - \frac{2-2A^2}{\pi}\arctan A. \tag{3.55}$$

The parameter 0<A<1 also represents the inverse E-field overshoot as a result of the presence of the electrodes.

The thickness of the electrodes can be arbitrarily small without introducing noticeable E-field distortions.

A negative curvature, e.g. at the openings along the beam path, further reduces the E-field amplitude.

This positive result can be traced back to the fact that the electrodes only cause local interference in an already existing E-field.

The optimal shape for free-standing high-voltage electrodes is ROGOWSKI- and BORDA profiles, with a peak value in the E-field amplitude of twice the undistorted field strength.

Drive Voltage Generator

The drive voltage generator must provide a high AC voltage at a high frequency. The usual procedure is to amplify an average AC voltage by a highly-insulated output transformer.

Interfering internal resonances, which are caused by unavoidable winding capacitances and leakage inductances, cause the draft of a design for such a transformer to be a challenge.

A charge pump can be an alternative thereto, i.e. a periodically operated semiconductor Marx generator. Such a circuit supplies an output voltage which alternates between ground and a high voltage of single polarity, and efficiently charges the first capacitor of the capacitor chain.

Dielectric Strength in the Vacuum $d^{-0.5}$-law

There are a number of indications—but no final explanation—that the breakdown voltage is approximately proportional to the square root of the spacing for electrode spacings greater than $d\approx10^{-3}$ m. The breakdown E-field therefore scales as per $$E_{max}=\sigma d^{-0.5} \tag{A.1}$$

with A constant, depending on the electrode material (see below). It appears as if currently available electrode surface materials require an electrode spacing distance of $d\leq10^{-2}$ m for fields of E≈20 MV/m.

Surface Materials

The flashover between the electrodes in the vacuum strongly depends on the material surface. The results of the CLIC study (A. Descoeudres et al. "DC Breakdown experiments for CLIC", Proceedings of EPAC08, Genoa, Italy, p. 577, 2008) show the breakdown coefficients

| material | | $\Phi$ in $\left(\frac{MV}{\sqrt{m}}\right)$ |
|---|---|---|
| steel | 3.85 | |
| SS 316LN | 3.79 | 3.16 |
| Ni | 3.04 | |
| V | | 2.84 |
| Ti | | 2.70 |
| Mo | | 1.92 |
| Monel | 1.90 | |
| Ta | | 1.34 |
| Al | 1.30 | 0.45 |
| Cu | 1.17 | 0.76 |

Dependence on the Electrode Area

There are indications that the electrode area has a substantial influence on the breakdown field strength. Thus:

$$E_{max} \approx 58 \cdot 10^6 \frac{V}{m}\left(\frac{A_{eff}}{1\ cm^2}\right)^{-0.25} \tag{A.2}$$

applies for copper electrode surfaces and an electrode area of $2*10^{-2}$ mm. The following applies to planar electrodes made of stainless steel with a spacing of $10^{-3}$ m:

$$E_{max} \approx 57.38 \cdot 10^6 \frac{V}{m}\left(\frac{A_{eff}}{1\ cm^2}\right)^{-0.12} \tag{A.3}$$

Shape of the Electrostatic Field

Dielectric Utilization Rate

It is generally accepted that homogeneous E-fields permit the greatest voltages. The dielectric SCHWAIGER utilization rate factor $\eta$ is defined as the inverse of the local E-field overshoot as a result of field inhomogeneities, i.e. the ratio of the E-field in an ideal flat electrode arrangement and the peak-surface E-field of the geometry when considering the same reference voltages and distances.

It represents the utilization of the dielectric with respect to E-field amplitudes. For small distances $d<6*10^{-3}$ m, inhomogeneous E-fields appear to increase the breakdown voltage.

Curvature of the Electrode Surface

Since the E-field inhomogeneity maxima occur at the electrode surfaces, the relevant measure for the electrode shape is the mean curvature H=(kl+k2)/2.

There are different surfaces which satisfy the ideal of vanishing, local mean curvatures over large areas. By way of example, this includes catenary rotational surfaces with H=0.

Each purely geometrical measure such as $\eta$ or H can only represent an approximation to the actual breakdown behavior. Local E-field inhomogeneities have a non-local influence on the breakdown limit and can even improve the general overall field strength.

Constant E-Field Electrode Surfaces

FIG. 8 shows KIRCHHOFF electrode edges in the case of A=0.6 for a vertical E-field. The field overshoot within the electrode stack is $1/A=1.\overline{6}$. The end faces are flat.

An electrode surface represents an equipotential line of the electric field analogous to a free surface of a flowing liquid. A voltage-free electrode follows the flow field line. Any analytical function w(z) with the complex spatial coordinate z=x+iy satisfies the POISSON equation. The boundary condition for the free flow area is equivalent to a constant magnitude of the (conjugated) derivative v of a possible function w.

$$\bar{v} = \frac{d\omega}{dz}. \tag{A.4}$$

Any possible function $w(\bar{v})$ over a flow velocity $\bar{v}$ or a hodograph plane leads to a z-image of the plane $$z = \int \frac{d\omega}{\bar{v}} = \int \frac{1}{\bar{v}} \frac{d\omega}{d\bar{v}} d\bar{v}. \tag{A.5}$$

Without loss of generality, the magnitude of the derivative on the electrode surface can be normalized to one, and the height DE can be denoted as A compared to AF (see FIG. 6). In the $\bar{v}$-plane, the curve CD then images on the arc i→1 on the unit circle.

In FIG. 8, points A and F correspond to 1/A, B corresponds to the origin, C corresponds to i and D and E correspond to 1. The complete flow pattern is imaged in the first quadrant of the unit circle. The source of the flow lines is 1/A, that of the sink is 1.

Two reflections on the imaginary axis and the unit circle extend this flow pattern over the entire complex $\bar{v}$-plane. The potential function $\omega$ is therefore defined by four sources at $\bar{v}$-positions +A, −A, 1/A, −1/A and two sinks of strength 2 at ±1.

$$\omega = \log(\bar{v} - A) + \log(\bar{v} + A) + \log\left(\bar{v} - \frac{1}{A}\right) + \log\left(\bar{v} + \frac{1}{A}\right) - 2\log(\bar{v} - 1) - 2\log(v + 1) \tag{A.6}$$

The derivative thereof is $$\frac{d\omega}{d\bar{v}} = \frac{1}{\bar{v} - A} + \frac{1}{\bar{v} + A} + \frac{1}{\bar{v} - \frac{1}{A}} + \frac{1}{\bar{v} + \frac{1}{A}} - \frac{2}{\bar{v} - 1} - \frac{2}{\bar{v} + 1} \tag{A.7}$$

and thus $$z - z_0 = \int \frac{1}{\bar{v}}\left(\frac{1}{\bar{v} - A} + \frac{1}{\bar{v} + A} + \frac{1}{\bar{v} - \frac{1}{A}} + \frac{1}{\bar{v} + \frac{1}{A}} - \frac{2}{\bar{v} - 1} - \frac{2}{\bar{v} + 1}\right) d\bar{v} \tag{A.8}$$

At the free boundary CD, the flow velocity is $\bar{v}=e^{i\Phi}$, hence $d\bar{v}=i\bar{v}|d\phi$ and $$z - z_0 = \int_{-\frac{\pi}{2}}^{-v} \frac{i}{e^{i\varphi} - A} + \frac{i}{e^{i\varphi} + A} + \frac{i}{e^{i\varphi} - \frac{1}{A}} + \frac{i}{e^{i\varphi} + \frac{1}{A}} - \frac{2i}{e^{i\varphi} - 1} - \frac{2i}{e^{i\varphi} + 1} d\varphi \tag{A.9}$$

with $z_0$=i b at point C. Analytic integration provides equation (3.54).

LIST OF REFERENCE SIGNS

9 High-voltage cascade
11 Input
13 Diode
15 Capacitor
17 Capacitor
19 Diode
21 Output
23 First set of capacitors
25 Second set of capacitors
31 High-voltage source
33 Intermediate electrode
35 High-voltage cascade
37 Central electrode
39 Outer electrode
39', 39" Electrode shell half
41 First capacitor chain
43 Second capacitor chain
45 AC voltage source
47 Equatorial cut
49 Diode
51 Acceleration channel through the second capacitor chain
52 Particle source
61 free-electron laser
61' Source for coherent X-ray radiation
53 Acceleration channel through the first capacitor chain
55 Magnet device
57 Synchrotron radiation
57' Photons from inverse Compton scattering
58 Laser beam
59 Laser device
63 Electron tubes
65 Cathode
67 Anode
81 High-voltage source

What is claimed is:

1. An accelerator for accelerating charged particles, comprising:

a capacitor stack comprising:

a first electrode configured to be brought to a first potential, a second electrode concentrically arranged with respect to the first electrode and which is configured to be brought to a second potential that differs from the first potential, and at least one intermediate electrode concentrically arranged between the first electrode and the second electrode and which is configured to be brought to an intermediate potential between the first potential and the second potential, a switching device to which the electrodes of the capacitor stack are connected, the switching device being configured such that, during operation of the switching device, the electrodes of the capacitor stack concentrically arranged with respect to one another can be brought to increasing potential levels, a first acceleration channel formed by first openings in the electrodes of the capacitor stack such that charged particles can be accelerated by the electrodes along the first acceleration channel, a second acceleration channel formed by second openings in the electrodes of the capacitor stack such that charged particles can be accelerated by the electrodes along the second acceleration channel, and a device configured to influence the accelerated particle beam in the interior of the capacitor stack, thereby creating photons in the interior of the capacitor stack.

2. The accelerator of claim 1, wherein the device is configured to provide a laser beam that interacts with the accelerated particle beam such that the emitted photons emerge from inverse Compton scattering of the laser beam at the charged particles of the accelerated particle beam.

3. The accelerator of claim 2, wherein the laser beam and the acceleration of the particles are tuned to one another such that the emitted photons lie in the X-ray spectrum.

4. The accelerator of claim 1, wherein the device is configured to generate a transverse magnetic field to the particle beam to bring about a deflection of the accelerated particle beam such that the photons are emitted from the particle beam as synchrotron radiation.

5. The accelerator of claim 4, wherein the transverse magnetic field is designed to cause a periodic deflection of the accelerated particle beam over a path in the interior of the capacitor stack.

6. The accelerator of claim 1, wherein the capacitor stack comprises a plurality of intermediate electrodes arranged concentrically with respect to one another and connected by the switching device such that, when the switching device is in operation, the intermediate electrodes can be brought to a sequence of increasing potential levels.

7. The accelerator of claim 1, wherein the electrodes of the capacitor stack are insulated from one another by a vacuum.

8. The accelerator of claim 1, wherein the switching device comprises a high-voltage cascade.

9. The accelerator of claim 1, wherein the capacitor stack is subdivided into two separate capacitor chains by a gap that runs through the electrodes.

10. The accelerator of claim 9, wherein the switching device comprises a Greinacher cascade or a Cockcroft-Walton cascade that interconnects the two mutually separated capacitor chains and which, in particular, is arranged in the gap.

11. The accelerator of claim 10, wherein the Greinacher cascade or the Cockcroft-Walton cascade is arranged in the gap.

12. A method for accelerating charged particles, comprising:

providing a capacitor stack comprising:

a first electrode configured to be brought to a first potential, a second electrode concentrically arranged with respect to the first electrode and which is configured to be brought to a second potential that differs from the first potential, and at least one intermediate electrode concentrically arranged between the first electrode and the second electrode and which is configured to be brought to an intermediate potential between the first potential and the second potential, controlling a switching device to bring the capacitor stack concentrically arranged with respect to one another to increasing potential levels, accelerating charged particles by electrodes along a first acceleration channel formed by first openings in the electrodes of the capacitor stack, accelerating charged particles by electrodes along a second acceleration channel formed by second openings in the electrodes of the capacitor stack, and using a device to influence the accelerated particle beam in the interior of the capacitor stack, thereby generating photons in the interior of the capacitor stack.

13. The method of claim 12, wherein the device is configured to provide a laser beam that interacts with the accelerated particle beam such that the emitted photons emerge from inverse Compton scattering of the laser beam at the charged particles of the accelerated particle beam.

14. The method of claim 13, wherein the laser beam and the acceleration of the particles are tuned to one another such that the emitted photons lie in the X-ray spectrum.

15. The method of claim 12, wherein the device is configured to generate a transverse magnetic field to the particle beam to bring about a deflection of the accelerated particle beam such that the photons are emitted from the particle beam as synchrotron radiation.

16. The method of claim 15, wherein the transverse magnetic field is designed to cause a periodic deflection of the accelerated particle beam over a path in the interior of the capacitor stack.

17. The method of claim 12, wherein the capacitor stack comprises a plurality of intermediate electrodes arranged concentrically with respect to one another and connected by the switching device such that, when the switching device is in operation, the intermediate electrodes can be brought to a sequence of increasing potential levels.

18. The method of claim 12, wherein the electrodes of the capacitor stack are insulated from one another by a vacuum.

19. The method of claim 12, wherein the capacitor stack is subdivided into two separate capacitor chains by a gap that runs through the electrodes.

20. The method of claim 19, wherein the switching device comprises a Greinacher cascade or a Cockcroft-Walton cascade that interconnects the two mutually separated capacitor chains and which, in particular, is arranged in the gap.

* * * * *